US005573016A

United States Patent [19]

Graves

[11] Patent Number: 5,573,016

[45] Date of Patent: Nov. 12, 1996

[54] TWO-PARTITE HAIR CURLER ASSEMBLY

[76] Inventor: Carol A. Graves, 3400 Tilden St., Brentwood, Md. 20722

[21] Appl. No.: 469,694

[22] Filed: Jun. 6, 1995

[51] Int. Cl.[6] ..... A45D 2/24; A45D 2/26; A45D 2/30

[52] U.S. Cl. ..... 132/254; 132/250; 132/262; 132/256; 132/264

[58] Field of Search ..... 132/250, 251, 132/253, 254, 256, 262, 268, 266, 261, 264, 257, 258

[56] References Cited

U.S. PATENT DOCUMENTS

| | | | |
|---|---|---|---|
| 2,789,565 | 4/1957 | Voorhees | 132/254 |
| 3,161,202 | 12/1964 | Mecca | 132/254 |
| 3,204,646 | 9/1965 | Chamberlain | 132/250 |
| 4,108,183 | 8/1978 | Mauro | 132/250 |
| 4,316,476 | 2/1982 | Merges | 132/253 |
| 5,033,487 | 6/1991 | Barradas | 132/254 |

*Primary Examiner*—Gene Mancene
*Assistant Examiner*—Philogene Pedro
*Attorney, Agent, or Firm*—Paul M. Craig, Jr.

[57] ABSTRACT

A two-partite hair curler which includes a first relatively fixed part and a second relatively movable part, movable between an extended and retracted position relative to the first part, whereby the second part has a curler surface on which hair is adapted to be wound in the extended position of the first part, and the first and second parts are provided with complementary locking devices for disengageably locking the second part in both the extended and retracted position.

42 Claims, 4 Drawing Sheets

TWO-PARTITE HAIR CURLER ASSEMBLY

FIELD OF THE INVENTION

The present invention relates to hair curlers, and more particularly to a two-partite hair curler assembly adapted to be locked in the extended and retracted positions.

BACKGROUND OF THE INVENTION

Hair curlers of the most varied constructions are known in the prior art for dry or vapor hair-setting systems as, for example, disclosed in U.S. Pat. Nos. 4,520,832; 4,453,554 and 4,526,184. Hair curlers designed specifically for microwave heating are disclosed in U.S. Pat. Nos. 4,538,630 and 4,710,609. However, the prior art hair curlers do not provide a good heat source nor a good insulation around the outside of the hair on the curler when the hair is wound around the curler on the head. Another problem encountered with the prior art hair curlers is the likelihood of hair unwinding from the curlers after the hair is wound upon them and while they remain in place for setting the hair. Moreover, many prior art curlers also require clips to hold the hair onto the curler. Because of the need for different sizes of clips for different sizes of desired curlers, the prior art curlers then posed a problem of quickly locating the right size of clip for the desired size of curler to be used. Additionally, the prior art curlers permit unimpeded heat radiation from the previously heated curlers into the air which not only reduces the energy efficiency, but also the effectiveness of the curlers.

SUMMARY OF THE INVENTION

It is a principal object of the present invention to avoid the shortcomings and drawbacks of the prior art by simple means which lend themselves to mass-production techniques, improve the energy efficiency of the curlers and the effectiveness of the curlers for their intended purposes.

The hair curler according to this invention is of two-partite construction which is easily adaptable to left- or right-handed users, whereby the relatively movable part including the curler surface on which the hair is curled can be extended from its relatively fixed housing part and upon completion of the hair-winding operation can be retracted again into the position within the housing part. Furthermore, the hair curler of this invention is provided with locking means to lock the relatively movable part in both its extended and retracted position, thereby preventing undesired unwinding of the hair. The hair curler of this invention also allows rotation of the curler rod until the hair is rolled and adjusted to the desired tightness of the hair on the rod of the curler and is then locked into that position. This is possible because the hair on the curler can be rolled onto the curler rod and be slid into the outer casing of the fixed part. If desired, the hair can be tightened or loosened by rotating the relatively movable part before it is locked within the relatively fixed part.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE DRAWINGS

Figure 1:
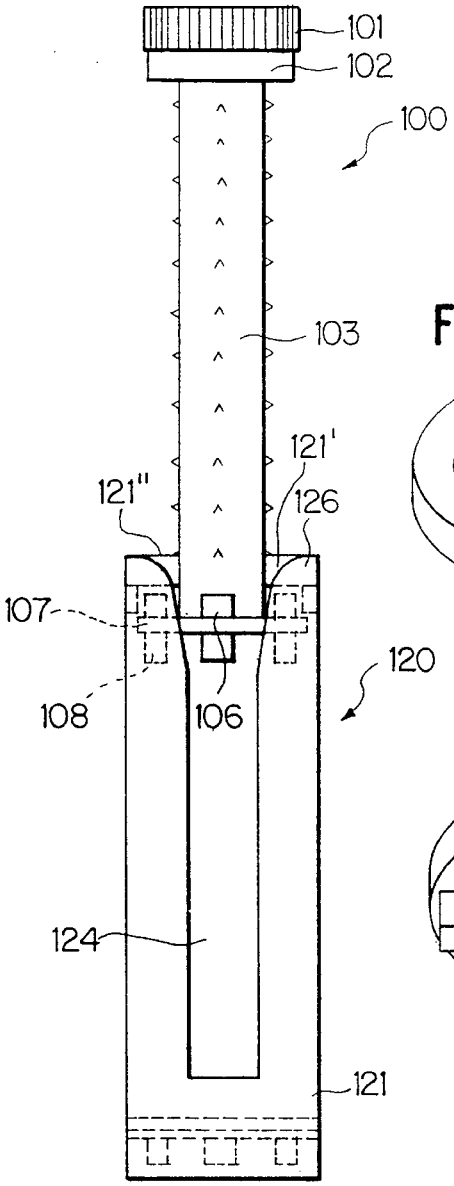
FIG. 1 is a somewhat schematic elevational view of a lockable two-partite hair curler in accordance with the present invention in the extended position.
Figure 2:
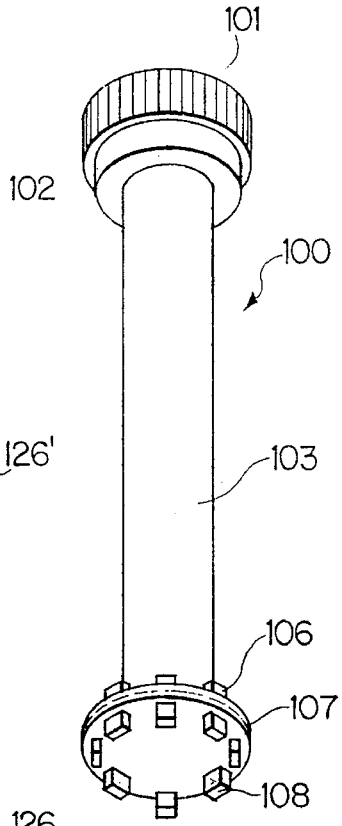
FIG. 2 is a somewhat schematic perspective view of the movable part of the lockable hair curler of FIG. 1.
Figure 4:
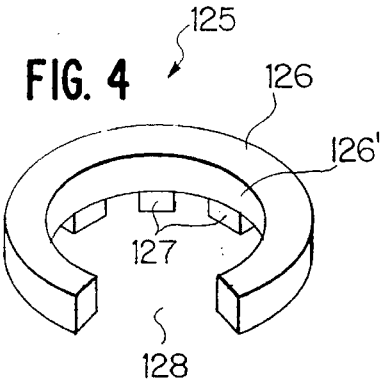
FIG. 4 is a somewhat schematic view of the ring member for the top of the relatively fixed housing part of the hair curler of FIG. 1, as viewed from the top and side thereof.
Figure 3:
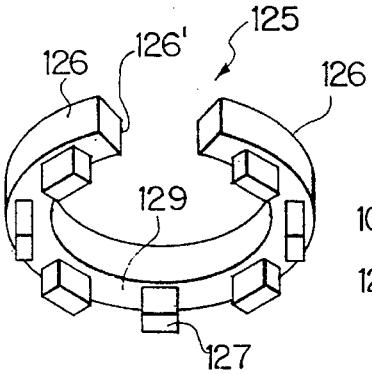
FIG. 3 is a somewhat schematic perspective view of the ring member for the top of the relatively fixed housing part of the hair curler of FIG. 1, as viewed from the bottom and side thereof.

Referring now to the drawing wherein like reference numerals are used throughout the various views to designate like parts, and more particularly to FIGS. 1 through 6, a two-partite lockable curler in accordance with the present invention is illustrated in these figures which is easily adaptable for right- or left-handed users and which offers numerous advantages over the curlers presently commercially available. More specifically, the two-partite consists of a relatively fixed curler part generally designated by reference numeral 120 forming a housing and of a relatively movable curler part generally designated by reference numeral 100. The relatively movable curler part 100 includes a curler cap 101 which can be made of non-heat-absorbing material, such as plastic or similar material, or of a layer of heat-tolerant non-heat-absorbing rubber-type material over a plastic material or of an all-plastic or similar material with the same qualities which can have a groove design around the outer circumference to allow for an easier grip when "rolling" or "wrapping" the hair. The curler cap 101 is preferably of the same diametric dimension as the outer diameter of the generally fixed housing part 120 (FIG. 5) for uniformness of shape and greater comfort to the user when the curler is on the head. The curler cap may be of a sturdy plastic material that can be heat-tolerant and stay cool to the touch which is especially necessary when the curler is of a design to be used in an electric heating system or a microwave energy-powered heating system for heat style curlers. The curler cap 101 is provided with a reduced rim 102 which may be of a shape complementary to the inside of the open end of the housing part 120 through which the movable part 100 extends and retracts. The reduced rim 102 preferably has a slightly protruding line or "lip" positioned around its outer circumference, for example, an annular lip or one or more circumferentially arranged lip portions to correspond with an appropriate counterpart such as an annular groove properly positioned around the inside circumference of the main opening in the housing part 120 which come in contact with one another when the movable part 100 is moved into its nearly fully retracted position so as to cause the lip to snap-in into the groove and thereby complete the locking process and prevent the curler cap 101 from popping out of the opening in the housing part 120. In other words, this arrangement assures that the relatively movable curler part 100 remains in its retracted position. As soon as the movable part 100 is released from its locking engagement in its extended position and before it reaches a locking engagement in its retracted position, the curler part 100 can be rotated relative to the part 120 to adjust for the correct tightness of the hair wound on the relatively movable part while the hair is already wrapped on the same. Once this adjustment is made, the relatively movable part 100 can then be further retracted and locked in position. The sequence of operation is the same as will be described in connection with the embodiment of FIGS. 7–13.

The curler cap 101 and reduced rim 102 is followed by a curler rod 103, properly speaking, which may be of any known construction, such as a solid curler rod, a hollow curler rod, a glass curler rod, a Corning Ware curler rod, a mesh-type or grated-type curler rod, a curler rod consisting of several reasonably thin and long bar-type rods forming a hollow center-type curler rod, a metal curler rod, a curler rod made of any suitable material such as plastic and/or metallic materials, and a curler rod made from a selection of the various materials and styles mentioned above with the addition of an outer layer of spongy material or an inner layer or a solid cylinder of spongy material within a hollow curler rod, or a curler rod filled with or made from a suitable a lossy dielectric material with a tiny opening in ring member 107 for heat pressure to escape, especially when a stationary guide is not used in the curler construction. This way the lossy dielectric material will come into direct contact with the curler rod for most efficient heating. Additionally, a wooden curler rod may also be used. The curler rod may be smooth on its outer surface or may be provided with small spikes or the like as known in the art, or it may use a curler clip such as curler clip 209 as will be described more fully in connection with the embodiment of FIG. 8. Such a curler clip has a shape following the curvature of the curler rod and is of approximately one-third to one-half of one inch in width and of an approximate one to two inches in length, for an average approximate three inch length of the curler rod. Such a curler clip extends along the length of the curler rod 103 and is firmly attached to the outer side of the curler rod near to or in the area just above or on the base ring member 107 while being unattached at its upper end. Such a curler clip which extends parallel along the outer surface of the curler rod and terminates short of reaching the reduced rim by approximately one to one and one-half inches on an average curler with a curler rod 103 of approximately three inches, allows the user to lift the unattached upper end of the curler clip to slide the ends of the hair under the curler clip and then proceed to roll the remaining length of the hair over the outer area of the curler clip. Further details of a curler clip will be discussed in connection with the embodiment of FIGS. 7 through 13, all of which are applicable also to the design of the two-partite lockable curler of FIGS. 1 through 6.

The base ring member 107, fixedly provided at the lower end of the curler rod 130, includes upper teeth 106 and lower teeth 108 protruding in opposite directions from the ring member 170. The upper and lower teeth 106 and 108 may thereby be formed by members individually extending through and projecting on both sides of the ring member 107 and suitably fastened therein. A particularly simple construction is attained if individual teeth protrude on both sides of the member 107, and each tooth member thereby forms both one of the upper and lower teeth 106 and 108.

The relatively fixed part 120 includes an outer housing casing 121 which may be closed or open at the bottom but does not need to be open except for a small opening in the center of the bottom for a heat rod to extend therethrough or for moisture penetration or for evaporation. A ring member generally designated by reference numeral 122 (FIGS. 1 and 6) is provided in the bottom of the housing 121 and is either fixedly inserted into the same or formed in one piece therewith, for example, by molding. The ring member 122 is provided with a number of uniformly spaced apertures 123 (FIG. 6) of a shape complementary to the shape and arrangement of the lower teeth 108 so as to enable inter-engagement and thereby lock the movable part 100 in any retracted position (FIG. 5) after the hair is wound or rolled to the desired "tightness" onto the curler rod 103 as described above. If not formed integral with the casing 121, the ring member 122 may be fixed in the casing 121 by a press-fit or by any other means such as adhesive fastening, welding or the like. To lock the movable part 100 in the extended position, a ring-like insert member generally designated by reference numeral 125 (FIGS. 3 and 4) is provided which is of part circular shape to fit into the inner axially extending surface portion 121', of the casing 121 to which it is secured in any known manner. The ring-like insert member 125 includes a top surface portion 126 followed by an axially extending inner surface portion 126'. The surface portion 126', may thereby extend in the axial direction to a point where it covers the teeth 127 on the inside to prevent hair from becoming entangled in the teeth 127. However, for the sake of simplicity, the shield thus formed is only shown in the embodiment of FIGS. 7–13. The ring-like insert member 125 is thereby located within casing 121 at an axial spacing from the top edge 121" which is at least slightly greater than the depth of the reduced rim 102 so as to prevent the reduced rim 102 from exerting any pressure on ring member 125 when the movable part 100 rests with the bottom surface of the curler cap 101 on the edge 121" with the movable part in the retracted position. The protruding lip or lips and groove are provided in the areas of the annular surface of rim 102 and of the inner upper surface portion 121' of the casing whereby the danger of inadvertent disengagement of the teeth 108 from apertures 123 as a result of recurring forces or pressure is minimized. The ring member 125 is additionally provided with downwardly extending teeth 127 to lock the hair curler in the extended position by engagement with the teeth 106. The hair wound upon the curler rod 103 can extend through a wide opening 124 in the casing 121 of the relatively fixed housing part 120. At the point where the hair is wound around the curler rod 103, only the housing 120 is able to slide or move at this time relative to the curler rod 103 from the position shown in FIG. 1 into the position shown in FIG. 5. The ring member 125 may be suitably secured in the top portion of the casing by any known means, such as press-fit, adhesive fastening, welding, etc., whereby the opening 128 in the ring member 125 is complementary to and aligned with the opening 124 in the casing 121. By suitably shaping and/or selecting the material for the teeth 106, 108 and the material for the insert member 122 and its recesses 123 as also for the teeth 127, an appropriate locking action can be achieved. For example, by suitably tapering the teeth in the various parts, this locking action can be enhanced so that the teeth can be kept of relatively short length.

Figure 7:
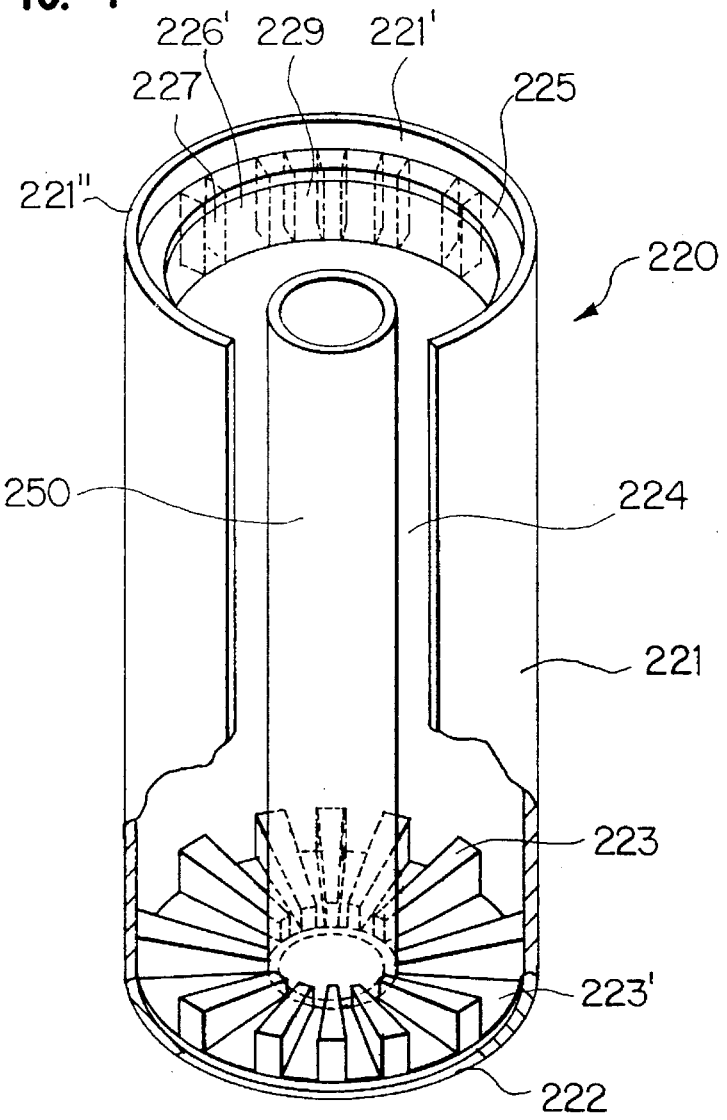
FIG. 7 is a somewhat schematic perspective view of the relatively fixed housing part of a modified embodiment of a two-partite hair curler according to this invention.
Figure 11:
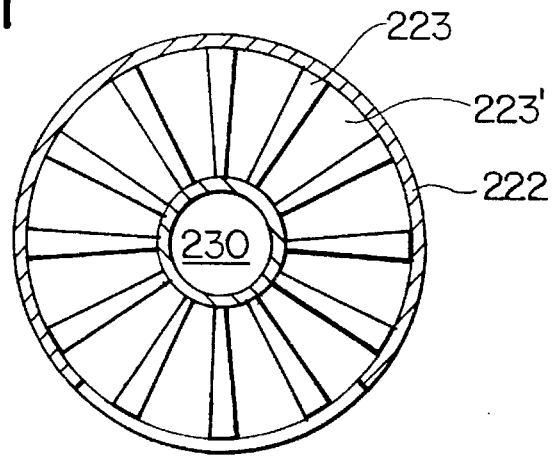
FIG. 11 is a top plan view on the bottom of the relatively fixed curler part of FIG. 7.

A stationary hollow tube or guide rod (not shown in the embodiment of FIGS. 1–6) may also be provided in the base of the relatively fixed part 120, similar to tube 250 of FIG. 7, to serve for the guidance of a curler rod 103, which is then of hollow construction. The stationary hollow tube thereby surrounds the opening in the base of the relatively fixed curler part 120 as will be explained by reference to the embodiment of FIGS. 7 through 13.

In the embodiment of FIGS. 7 through 13, parts similar to the parts of the embodiment of FIGS. 1 through 6 are designated by reference numerals of the 200 series and will therefore not be described in detail. The relatively fixed part 220 is provided with a hollow guide rod generally designated by reference numeral 250 which extends up to within the area below the insert ring member 225. The ring member 225 is again located within casing 221 so as to avoid any pressure thereon by reduced rim portion, as explained above and includes a shield or guard portion 226' on the inside of the teeth 227 to prevent hair from becoming entangled in the teeth 227. This shield or guard is simply formed by extending an annular portion axially to the same depth as teeth 227. The hollow guide rod 250 surrounds the opening 230 (FIG. 11) in the base member 222 which closes the bottom of the relatively fixed part 220 except for the opening 230. Tapering teeth 223 are provided on the base member 222 to form the tapering openings 223' into which teeth 208 (FIG. 10) on the ring member 207 can engage. The base member 222, if not formed integral with the relatively fixed part 220, can again be fastened thereto by any suitable means such as press-fit, adhesive bonding, welding, etc. The stationary hollow guide rod 250 as also the curler rod 203 may be made from plastic material, metal, glass, Corning Ware or of a suitable lossy dielectric material and the like. It may be made also of mesh-type, of grated construction, and may be made solid or with the use of long rods and provides a longitudinal guide for the curler rod 203 to slide up and down or on and off. The stationary hollow guide tube 250 may also have an internal cross section such that a heat rod or heat post can be inserted into the same from outside of the base member 222 of the curler. The hollow guide tube 250 may be solid, perforated, plastic or of heat-retaining material depending upon the type of the curler. It may also be made from or filled with a lossy dielectric material in case of microwave energy use. The stationary guide tube 250 causes the hollow curler rod 203 to slide more firmly yet freely into the extended and retracted positions without wobbling or wiggling. Preferably the stationary guide tube is almost as long or as long as the hollow curler rod 203 which may be made from similar materials as used with the guide tube 250 or as described in connection with curler rod 103.

In the embodiment of FIGS. 7 through 13, as in the embodiment of FIGS. 1 through 6, the reduced rim 202 provided with a lip (not shown) is of such dimension that it can again snap-in into the groove (not shown) formed in the inner surface portion 221' of the casing 221 to retain the movable part 200 in its fully retracted position.

Figure 5:
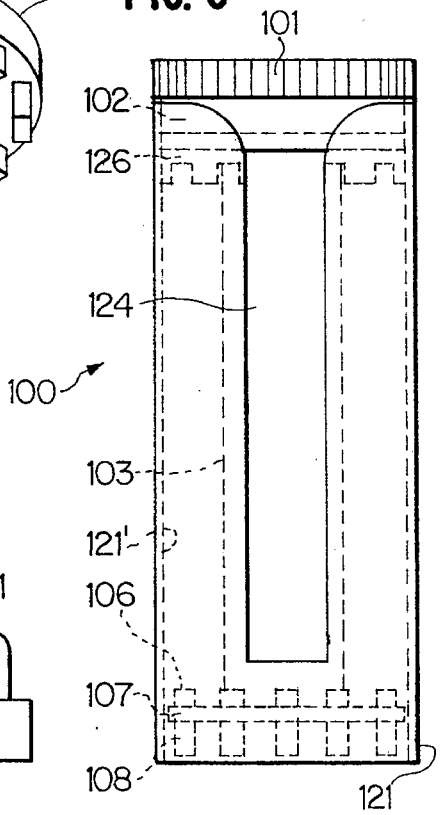
FIG. 5 is an elevational view, similar to FIG. 1 but on a somewhat enlarged scale and showing the relatively movable part of the hair curler of this invention in the retracted position within the housing of the relatively fixed part.
Figure 6:
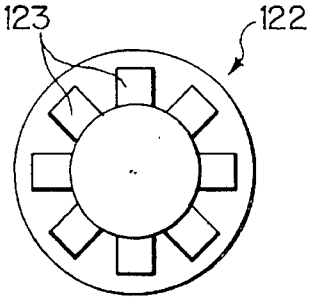
FIG. 6 is a top plan view on the bottom ring member in the relatively fixed housing part.
Figure 14:
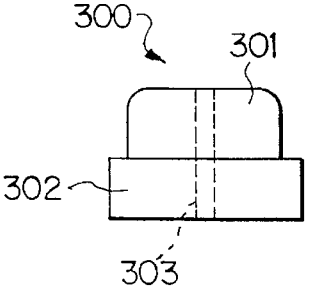
FIG. 14 is a side elevational view of a plug member for use with a two-partite curler of this invention.
Figure 8:
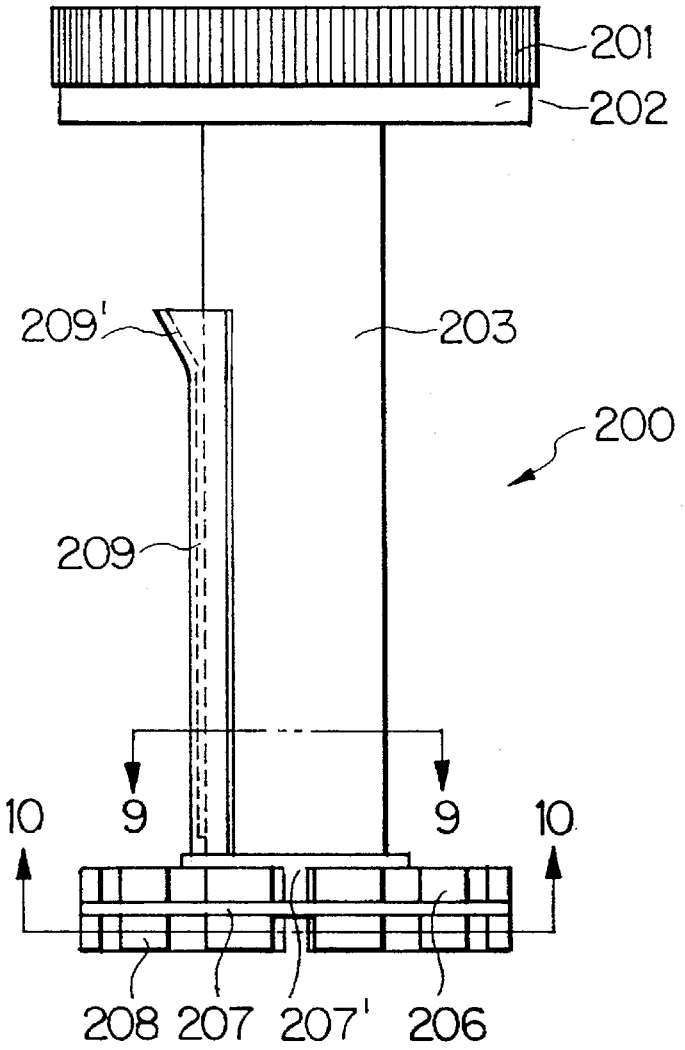
FIG. 8 is a somewhat schematic elevational view of the relatively movable member of the two-partite hair curler for use with the relatively fixed part of FIG. 7.
Figure 9:
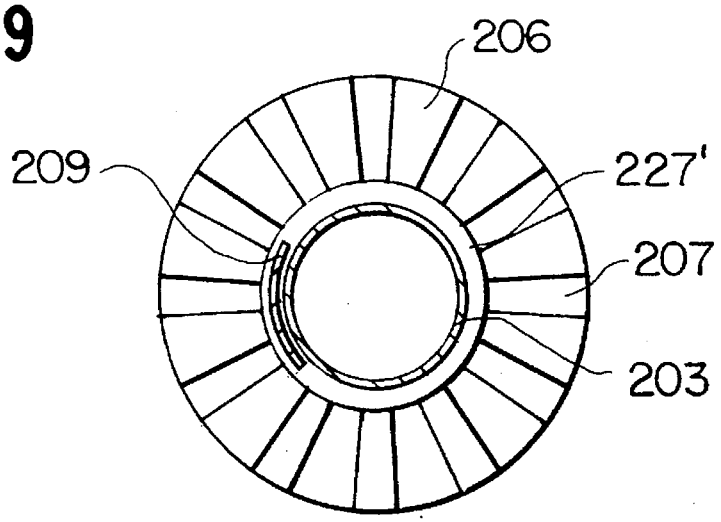
FIG. 9 is a cross-sectional view taken along line 9—9 of FIG. 8.
Figure 10:
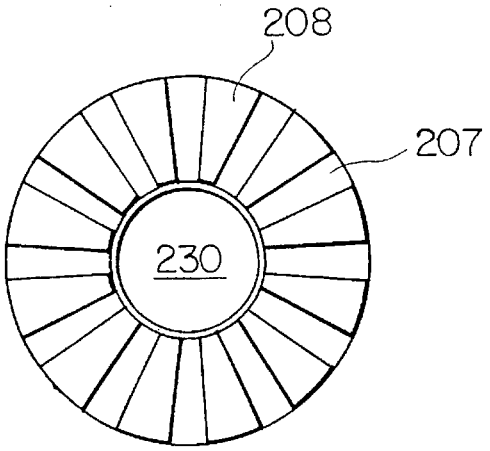
FIG. 10 is a cross-sectional view taken along line 10—10 of FIG. 8.
Figure 12:
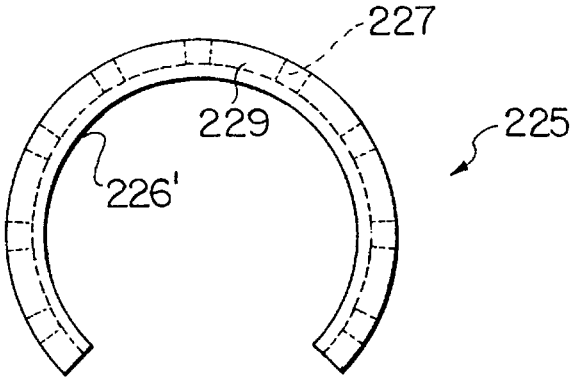
FIG. 12 is a top plan view on the top insert ring member of the relatively fixed curler part.
Figure 13:
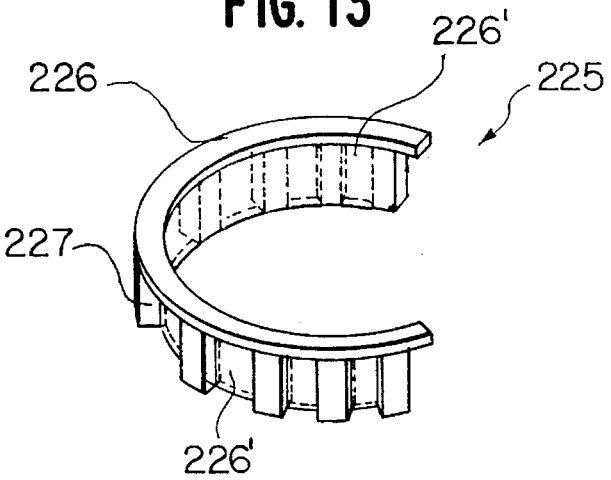
FIG. 13 is a somewhat perspective view of the insert ring member of FIG. 12, as viewed from above and the side thereof.

A method for using the curler could be as follows:

Beginning with the curler 100, 200 in a retracted, locked position, such as in FIG. 5, and if the curler has just been removed from a heat source such as from microwave energy source or standard electricity source, a plug member 300 as in FIG. 14 may be quickly introduced into the opening 230 at this point to avoid any excess heat loss, as will be more fully described in FIG. 14. For use, the curler's outer housing 121, 122 is grasped in one hand of the user and the cap 101, 201 in the other hand. The cap 101, 201 is then gently pulled in an outward motion to disengage the snap-in lip or groove engagement (not shown) that may be present on the outer surface of the reduced rim 102, 202 meeting with its complementary or counterpart lip or groove on the inner surface 121', 221' of the area near the open end of the outer casing 121, 221. The cap 101, 201 is then pulled outwardly to its farthest extended position and at this point while the cap is still being gently pulled, the cap is rotated slightly to cause the teeth 106, 206 to engage with the teeth 127, 227 to cause a locking action. These actions will have caused the curler part 100, 200 to be locked into an extended stationary position with respect to the fixed housing part 120, 220 so as to cause the entire curler 100, 200, 120, 220 to rotate as a whole when the hair is wound upon it. At this point, the ends of a chosen lock of wet or dry hair are positioned onto the curler rod 103, 203. The hair ends may be assisted in being held onto the curler rod 103, 203 by one or more of several means such as properly positioned short protruding teeth as shown in FIG. 1 or a clip 209 as shown in FIG. 8 or an end paper (not shown) or a thin layer of Velcro, to name a few. The entire curler is then rotated in the chosen direction to allow the hair to be wound to the desired position on the hair where curling action is desired. The winding action may be stopped at any point on the lock of hair where curling action is desired or may be continued to be rolled as close to the scalp as curling action is desired and as is comfortable to the user. At this point, the outer casing 120, 220 is pushed in an inward direction towards the curler cap 101, 201 thus disengaging the outer locked position. The outer housing 120, 220 is then rotated until the opening 124, 224 is facing the scalp and the extension (hair that is between scalp and the curler rod) of the lock of hair joined to the scalp and upon the curler rod 103, 203 allowing this extension of hair to pass into this opening 124, 224. At this point, the cap 101, 201 is rotated slightly to the desired tightness and comfort of the hair between the scalp and the rod 103, 203. Next, the part 120, 220 is continued to be pushed inwardly while slightly rotated to its completely retracted, snapped-in position in which the lower teeth 108, 208 engage with apertures or teeth 123, 223 and finally the snap-in lip and groove areas in the reduced rim 102, 202 and the top inner surface of housing 121', 221' that may be present come into their fully intended locked engagement or engaged position. Then, the curler is to remain in its retracted position until ample time of curling or waving of the hair has been accomplished. At this point, the user could add waving lotion, such as used in permanents, a neutralizer, hair spray or any other curling products desired that were not added to the hair prior to rolling it on the curler rod 103, 203. Additionally, external heat could be applied, or the hair could be air-dried or any other desired known hair treatment could be applied at this point. When the curling process has been accomplished, the curler's outer housing 121, 221 is grasped in one hand of the user and the cap 101, 201 in the other hand. The outer housing 121, 221 is then gently pulled in an outward motion to disengage the snap-in lip or groove engagement that may be present on the outer surface of the reduced rim 102, 202 meeting with its complementary or counterpart lip or groove on the inner surface of the area near the open end of the outer casing 121, 221. The outer housing 121, 221 is then pulled outwardly to its farthest extended position and at this point while the outer housing is still being gently pulled, the housing 121, 221 and/or the cap 101, 201 is rotated slightly to cause the teeth 106, 206 to engage with the teeth 127, 227 to cause a locking action. These actions will have caused the fixed housing part 120, 220 to be locked into an extended stationary position with respect to the curler part 100, 200 so as to cause the entire curler 100, 200, 120, 220 to rotate as when the hair was rolled upon it. The curler would be rotated in the reverse direction as when the hair was rolled upon it. When the rotating process is accomplished, the lock of hair is removed from the curler rod. This process would be repeated for each curler wound upon the head. The curler could be retracted to its closed state for storing.

The outside surface of the curler rod 203 may be smooth or of any known type, such as of grated surface, of long rod-like surface, of perforated surface, of mesh-type surface, etc., whereby a curler clip generally designated by reference numeral 209 is provided which has a shape following the curvature of the curler rod 203. The length of the arc over which the curler clip extends can be chosen at will for a given design, but need not extend over more than one-sixteenth to one-third of the circumference of the curler rod 203. The spacing between the inside surface of the curler clip 209 and the outside surface of the curler rod 203 can also be chosen to optimize performance for a given curler design. The curler clip 209 extends along the outer surface of the curler rod 203 substantially parallel thereto and is firmly attached to the outer curler rod 203 near the area just above the ring member 207 or directly to the ring member 207 by any conventional means. At its upper end, the curler clip 209 remains unattached and terminates short of the reduced rim portion 202 by approximately one to one and one-half inches with an average-curler having a curler rod length of approximately three inches to allow the user to lift the unattached upper end and slide the ends of the hair under the curler clip 209 to then proceed to roll the remaining length of the hair as is conventional procedure in most cases where clips are applied to the curler rod after the hair has been rolled onto the same. To facilitate lifting of the free end of the curler clip 209, the latter is provided with a bent end section 209' extending outwardly and upwardly from the curler rod as viewed in FIG. 8, preferably with a gap between the outwardly bent tip 209' and the curler rod 203 for greater ease of slipping the user's finger into this area. This allows the user to slide a finger under the unattached upper end for greater ease of sliding the ends of the hair under the curler clip 209. Also, the other popular methods to "grip" or "catch" or "grab" the ends of the hair may be used when placing the tip ends of the hair onto the curler rod 203, utilizing known constructions of appropriate shapes and sizes such as a sufficient amount of appropriately spaced teeth of an adequate length and width or a proper length and spacing of Velcro-type material, or a clip of a choice of many different designs appropriate for the design of a curler such as C-shaped clips following the shape, length, diameter and circumference of the curler rod 203, each made of an appropriate material for its specific curler to which it is applied. This is especially important when very short hair is being rolled and/or when hair is being set dry and does not cling well to a curler rod without some assistance. In the absence of any of these methods or in addition thereto, an end paper may also be used. Also differing from the embodiment of FIGS. 1 through 6, the ring member 207 is adjoined by a cylindrical base member 207' of reduced diametric dimension and relatively short height whereby the curler clip 209 may also be fastened in the base member 207'. The base member 207', which is of sufficient height to extend above the teeth 206, thereby represents a stop for hair wound on the curler rod 203 and thus avoids that hair can be caught and become entangled in the area of the teeth 206.

Differing from the embodiment of FIGS. 1 through 6, the curler rod 203 of FIGS. 7–13 is also open at the bottom whereby such opening extends through the parts 227' and 207 to permit the guide tube 250 to extend into the curler rod 203.

FIG. 14 illustrates a plug member generally designated by reference numeral 300 whose reduced insert portion 301 is of appropriate shape to fit tightly into opening 230 so as to avoid heat losses through this opening 230 when the curler is removed from its heating environment, such as from a heating compartment as described in my copending application filed on even date and entitled "Energy Efficient Hair Curler System." The plug member 300 is preferably provided also with a small vent hole 303 extending through the insert portion 301 and handle portion 302. It may be made of a rubbery, firm plastic material or the like to fit snugly and firmly causing a thorough seal, yet made to be easily inserted and removed from opening 230.

As to the rest, what has been said with respect to the embodiment of FIGS. 1 through 6 is applicable to the embodiment of FIGS. 7 through 14 and vice versa with some of the features of the embodiment of FIGS. 7 through 14 applicable also to the embodiment of FIGS. 1 through 6.

The two-partite curler of this invention offers significant advantages by the presence of an outer housing made of known insulating material, such as, for example, solid plastic or Styrofoam and made of properties to keep its surface cool as well as providing insulation in the partially closed housing design 121, 221 so as to retain heat in the respective curler rod 103, 203 while still allowing breathing room between the inside of the outer housing 121, 221 and the hair wound on rod 103, 203 which is an advantage and especially appropriate when steam is used. An open outer housing design 121, 221 would allow for evaporation of moisture, for permanent lotion and/or neutralizer, etc. for permanent waves to be added. Furthermore, the two-partite curler of this invention prevents unwinding of the hair from the curler and offers simple construction, ease of assembly and facilitated handling. In use, it is only necessary to displace the movable part 100, 200 into its extended position shown, for example, in FIG. 1 in which the teeth 106, 206 by engagement with the teeth 127, 227 will cause the movable part 100, 200 to be locked in position whereupon the hair can be wound on the curler rod 103, 203. Upon completion of this curling operation, the movable part 100, 200 is then retracted by sliding the relatively fixed part 120, 220 with its opening 124, 224 toward the hair that is attached to the scalp so that the hair which remains unwound between the rod 103, 203 and the scalp will pass through the opening 124, 224. To retract the movable curler part 100, 200 once the hair is wound around the curler rod 103, 203, it is necessary to slide the relatively fixed part 120, 220 to provide the relative movement because the relatively movable part 100, 200 now cannot move except to roll or unroll after hair is already wound around it. The hair wound on the curler rod 103, 203 is able to exit the curler housing 120, 220 through the opening 124, 224. The locking action in the retracted position of the movable part 100, 200 can be further improved by suitably tapering the openings 129, 229 of insert member 125, 225 and/or suitably dimensioning, respectively, tapering the teeth 108, 208 that come in contact with the apertures 123, and/or teeth 223 and spaces 223'. The curler of this invention can be used with any known curler system as also with a curler system as disclosed in my aforementioned copending application filed on even date and entitled "Energy Efficient Hair Curler System," the subject matter of which is incorporated herein in its entirety.

The hair curler according to this invention can be used also for air dry or hair-dryer style curlers and for permanent wave rods for permanents. In case of very short hair, the curler of this invention may also have a very thin U-shaped long clip to be used over the tips of hair just rolled onto the curler. Furthermore, to grab the ends of the hair, in addition to or in the alternative of the curler clip 209, the curler rod may be provided with teeth or a thin layer of Velcro or any other method may be used to grab the beginning of hair to be rolled so as to hold it onto the curler rod. The teeth 223 are extended radially inwardly with appropriate taper to assist in supporting the guide tube 250.

While I have shown and described only two embodiments in accordance with the present invention, it is understood that the same is not limited thereto but is susceptible of numerous changes and modifications as known to those skilled in the art. For example, the lip(s) may also be provided on the inside surface of casing 121, 221 and the groove(s) on the annular surface of rim portion 102, 202. The curler cap may also be made of a rubbery layer over a plastic base or of any other known material having similar properties to keep its surface cool and thereby prevent burning of the fingers when the curler cap is grasped by the user's fingers. Of course, tongs might also be used to remove a heated curler. I therefore do not wish to be limited to the details shown and described herein, but intend to cover all such changes and modifications as are encompassed by the scope of the appended claims.

I claim:

1. A two-partite hair curler, comprising a first relatively fixed part and a second relatively movable part movable between an axially extended and retracted position relative to said first part, said second part including a cap member and curler surface means on which hair is adapted to be wound in the extended position of said first part, and locking means on said first and second parts for disengageably locking said second part in the extended and retracted positions thereof.

2. A two-partite hair curler according to claim 1, in which said first part includes an opening for hair wound on said curler surface means to extend therethrough with the second part in the retracted position.

3. A two-partite hair curler according to claim 1, wherein said locking means includes complementary engageable means on said second and first parts operable to detachably lock the second part in its extended and retracted positions.

4. A two-partite hair curler according to claim 3, wherein said complementary engageable means include tooth-like means on at least one of the two parts operable to engage in tooth-receiving means in at least the other of said two parts.

5. A two-partite hair curler according to claim 4, wherein said second part includes upwardly and downwardly extending uniformly spaced tooth-like means in the end area of said curler surface means opposite said cap member, and wherein said first part is provided with an open end of a size sufficient to permit reciprocating movement therethrough of the curler surface means while the other end is at least partially closed off and includes complementary engageable means adapted to lockingly but detachably engage with the tooth-like means on the second part which extend in a direction away from said cap member.

6. A two-partite hair curler according to claim 5, wherein said other end is closed off.

7. A two-partite hair curler according to claim 5, in which said first part is provided in the area of its open end with complementary engageable means adapted to lockingly but detachably engage with the tooth-like means on said second part which extend in the direction toward said cap member.

8. A two-partite hair curler according to claim 7, wherein said second part is provided with a first ring-like member within the area of the curler surface means opposite said cap member, and wherein said tooth-like means extend in the upward and downward direction from said first ring-like member.

9. A two-partite hair curler according to claim 8, wherein said first part includes housing means provided with an opening for hair wound on said curler surface means to extend therethrough, and wherein said complementary engageable means include a second ring-like member in said housing means within the area opposite its open end, said second ring-like member being provided with the complementary engageable means for engagement with the downwardly extending tooth-like means on said first ring-like member.

10. A two-partite hair curler according to claim 9, further comprising a third ring-like member secured in the area of the open end of said first part, said third ring-like member being open in the circumferential direction for hair to pass therethrough and being provided with said complementary engageable means into which the upwardly extending tooth-like means on said ring can lockingly but detachably engage.

11. A two-partite hair curler according to claim 10, wherein said further insert member has an internal surface providing a wedging action with the curler surface means of the second part.

12. A two-partite hair curler according to claim 8, wherein the tooth-like means on said first ring-like member are formed by individual tooth members extending through and fastened in said first ring-like member, and wherein the upwardly extending portion of an individual tooth-like member forms part of the upwardly extending tooth-like means while the downwardly projecting portion of an individual tooth member forms part of the downwardly extending tooth-like means.

13. A two-partite hair curler according to claim 3, wherein at least some of said complementary means are wedge-shaped to produce a detachable locking action.

14. A two-partite hair curler according to claim 3, further comprising snap-in means on said first and second parts operable to frictionally retain the second part in its retracted position after initial engagement of the complementary engageable means to thereby prevent said second part from popping out from the top of the first part and from disengagement of the complementary engageable means which would allow unwinding of hair from the curler surface means.

15. A two-partite hair curler according to claim 11, further comprising snap-in means on said first and second parts including lip and groove means, said snap-in means being operable to prevent said second part from popping-out of its retracted position from the top of the first part and thus to preclude undesired rotation of the curler surface means which might cause the hair to unwind.

16. A two-partite hair curler according to claim 1, wherein said curler surface means extends away from said cap member, and wherein said first part has an open end, and further comprising a stationary rod-like member in said first part, said rod-like member extending from an end are opposite said open end in a direction opposite the curler rod for guiding the curler rod which is hollow, in its reciprocating movements.

17. A two-partite hair curler according to claim 1, wherein said curler surface means is formed by a curler rod.

18. A two-partite hair curler according to claim 17, wherein said curler rod is hollow and is filled with a lossy-dielectric material.

19. A two-partite hair curler according to claim 18, wherein said closed curler rod is closed at both the end near the cap member and its opposite end except for a small pressure release opening in the opposite end.

20. A two-partite hair curler according to claim 19, wherein the lossy dielectric material in said curler rod is enclosed in a pouch-like means to protect it from moisture.

21. A two-partite hair curler according to claim 20, wherein said pouch-like means is made from a shrink-wrap plastic material which can expand when heated.

22. A two-partite hair curler according to claim 1, wherein said curler surface means is made from any one of plastic, wooden, glass, ceramic or metallic material and may have any one of a perforated structure, grated structure, rod-like structure, spirally shaped structure, hollow structure, solid structure and smooth outer layer structure.

23. A two-partite hair curler according to claim 1, wherein said first part is open at one end and at least partially closed at the other end having a central opening, further comprising a tubular-shaped guide member extending from said partially closed end toward said open end and being operable to guide said curler surface means constructed as hollow curler rod during its reciprocating movements.

24. A two-partite hair curler according to claim 22, wherein said guide member is made from any one of plastic, wooden, glass, ceramic or metallic or lossy dielectric material.

25. A two-partite hair curler according to claim 23, wherein said guide member is of any one of mesh-type construction, grating-type construction or rod-type construction or of hollow construction with a solid outer smooth surface.

26. A two-partite hair curler according to claim 1, wherein said curler surface means includes a curler rod which extends away from said cap member, and wherein said first part has an open end, and further comprising a stationary rod-like member in said first part, said rod-like member extending from an end area opposite said open end in a direction opposite the curler rod and being solid.

27. A two-partite hair curler according to claim 1, wherein said curler surface means includes means for grabbing the hair ends farthest removed from the scalp.

28. A two-partite hair curler according to claim 27, wherein said grabbing means includes at least one of clip means, teeth means and a thin layer of Velcro.

29. A two-partite hair curler according to claim 27, wherein said clip means is a thin U-shaped clip.

30. A two-partite hair curler according to claim 28, further comprising a curler clip means extending substantially parallel to said curler rod from the end area of said second part opposite its cap member, said curler clip means being fastened only in said end area of said second part so that hair ends can be slipped under the open end of said curler clip means toward the center area thereof.

31. A two-partite hair curler according to claim 9, further comprising a curler clip which is fastened at one end to an area above said first ring-like member and extends toward the open end of said first part in substantially parallel relationship to said curler surface means so that the curler clip can be bent away springily at its open end from said curler surface means to permit hair to be slipped into the gap between the curler clip and the curler surface means.

32. A two-partite hair curler according to claim 10, wherein said third ring-like member is provided with a shield means radially inwardly of its complementary engageable means to prevent hair from becoming entangled in said last-mentioned engageable means.

33. A two-partite hair curler according to claim 8, wherein said first ring-like member includes additional means to prevent hair from becoming entangled with the tooth-like means extending in the upward direction.

34. A two-partite hair curler according to claim 33, wherein said additional means includes a raised portion in the area where the first ring-like member forms the curler surface means to keep the hair above the upper surface of the tooth-like means extending in the upward direction.

35. A two-partite hair curler according to claim 1, wherein said first part is open at one end and partially closed at the other end having a central opening, wherein said curler surface means includes a hollow curler rod, and further comprising a plug means made from rubber-like material and provided with a small center vent means for pressure release, said plug means being operable to be inserted into said central opening to trap heat inside of the hollow curler rod upon removal of the curler rod from a heat source.

36. A two-partite hair curler, comprising a first relatively fixed part and a second relatively movable part movable axially between an extended position and a retracted position relative to said first part, said second part including a cap member and curler surface means on which hair is adapted to be wound in the extended position of said first part, locking means on said first and second parts for disengageably locking said second part in the extended position thereof, and further frictional locking means on said first and second parts for disengageably locking said second part in the retracted position so that hair is adapted to be wound on said curler surface means by rotating said first and second parts as a unit, and said second part is adapted to be moved upon disengagement of said locking means into the retracted position in which said further locking means assists in preventing unwinding of the hair.

37. A two-partite hair curler according to claim 36, wherein said locking means and said further locking means include complementary frictionally engageable means on said second and first parts operable to detachably lock the second part in its extended and retracted positions.

38. A two-partite hair curler according to claim 37 wherein said complementary frictionally engageable means include tooth-like means on at least one of the two parts operable to engage in tooth-receiving means in at least the other of said two parts.

39. A two-partite hair curler according to claim 36, wherein said second part includes upwardly and downwardly extending tooth-like means in the end area of said curler surface means opposite said cap member, and wherein said first part is provided with an open end of a size sufficient to permit reciprocating movement therethrough of the curler surface means while the other end includes complementary engageable means adapted to lockingly but detachably engage with those tooth-like means on the second part which extend in a direction away from said cap member.

40. A two-partite hair curler according to claim 36, in which said first part includes an opening for hair wound on said curler surface means to extend therethrough with the second part in the disengageably locked retracted position.

41. A two-partite hair curler according to claim 37, wherein at least some of said complementary means are wedge-shaped to produce a detachable locking action.

42. A two-partite hair curler according to claim 37, further comprising snap-in means on said first and second parts operable to frictionally retain the second part in its retracted position after initial engagement of the complementary frictionally engageable means to thereby prevent said second part from popping out from the top of the first part and from disengagement of the complementary frictionally engageable means which would allow unwinding of hair from the curler surface means.

* * * * *